US005382372A

United States Patent [19]

Eicken et al.

[11] Patent Number: 5,382,372

[45] Date of Patent: Jan. 17, 1995

[54] SPINNING PREPARATIONS IN THE FORM OF AQUEOUS EMULSIONS OR AQUEOUS SOLUTIONS CONTAINING POLYMERS

[75] Inventors: Ulrich Eicken; Raymond Mathis, both of Duesseldorf; Heidi Fiedler, Korschenbroich; Manfred Gorzinski, Duesseldorf, all of Germany

[73] Assignee: Henkel Kommanditgesellschaft Auf Aktien, Duesseldorf, Germany

[21] Appl. No.: 867,704

[22] PCT Filed: Dec. 21, 1990

[86] PCT No.: PCT/EP91/02288

§ 371 Date: Jul. 8, 1992

§ 102(e) Date: Jul. 8, 1992

[87] PCT Pub. No.: WO91/10717

PCT Pub. Date: Jul. 25, 1991

[30] Foreign Application Priority Data

Jan. 8, 1990 [DE] Germany ..... 4000304

[51] Int. Cl.[6] ..... D06M 15/00

[52] U.S. Cl. ..... 252/8.6; 252/8.8; 252/8.9; 252/49.5; 428/361; 428/394; 428/395; 524/554; 524/612

[58] Field of Search ..... 252/8.6, 8.7, 8.8, 8.9, 252/49.5; 428/361, 394, 395; 524/554, 612

[56] References Cited

U.S. PATENT DOCUMENTS

| | | | |
|---|---|---|---|
| 3,977,979 | 8/1976 | Crossfield et al. | 252/8.8 |
| 4,078,133 | 3/1978 | Ozima | 526/303.1 |
| 4,098,702 | 7/1978 | Crossfield et al. | 252/8.6 |
| 4,169,061 | 9/1979 | Carver et al. | 252/8.9 |
| 4,294,883 | 10/1981 | Hawkins | 252/8.6 |
| 4,310,434 | 1/1982 | Choy et al. | 252/174.21 |
| 4,400,281 | 8/1983 | Dehm | 252/8.6 |
| 4,915,855 | 4/1990 | Gillberg-LaForce et al. | 252/8.9 |

FOREIGN PATENT DOCUMENTS

| | | |
|---|---|---|
| 0127293 | 12/1984 | European Pat. Off. . |
| 0261415 | 3/1988 | European Pat. Off. . |

OTHER PUBLICATIONS

Chemical Abstracts of Japan, JP 2 68,370, 1990 Mar.

Chemiefasern/Textil-Industrie, 1977, pp. 328-335 no month available.

*Primary Examiner*—Paul Lieberman

*Assistant Examiner*—Michael Tierney

*Attorney, Agent, or Firm*—Ernest G. Szoke; Wayne C. Jaeschke; John Daniel Wood

[57] ABSTRACT

The invention relates to spinning finishes in the form of aqueous emulsions or aqueous solutions containing water-soluble polymer compounds hvaing weight average molecular weights of more than $10^6$.

9 Claims, No Drawings

SPINNING PREPARATIONS IN THE FORM OF AQUEOUS EMULSIONS OR AQUEOUS SOLUTIONS CONTAINING POLYMERS

FIELD OF THE INVENTION

This invention relates to spinning finishes in the form of aqueous emulsions or aqueous solutions containing water-soluble polymer compounds having weight average molecular weights of more than $10^6$, to a process for reducing the spraying of spinning finishes from fiber surfaces and to the use of certain water-soluble polymer compounds having weight average molecular weights of more than $10^6$ in aqueous emulsion or aqueous solutions of spinning finishes for reducing the spraying of spinning finishes from fiber surfaces.

STATEMENT OF RELATED ART

In the manufacture of man-made fibers spun from the melt, the first processing step immediately after the capillaries emerge from the spinning jet, i.e. immediately after formation of the filaments, is the treatment of the fiber surface with spinning finishes containing smoothing agents and antistatic agents as their principal active substances (*Chemiefasern/Textil-Industrie* 1977, 328–335). It is generally known that man-made fibers can neither be produced nor used in textile further processing without such finishes. A smoothing agent has to be applied because the original surface of most polymeric fibers gives rise to considerable friction forces so that chafing of the fibers occurs through the constant contacts, for example with guide elements, during the production and processing cycles and can ultimately result in filament or yarn breakages. In addition, polymeric filament materials generally absorb only a little water so that they tend to develop electrostatic charges.

High-speed machines with filament speeds of up to 6,000 m/minute are now commonly used in the production and further processing of fibers. At these high speeds, a considerable percentage of the textile lubricants applied, such as spinning finishes or winding oils, is often sprayed off. Not only is this spraying of the lubricants a waste, it is also virtually impossible as a result of spraying to keep to the exact quantities to be applied for the individual processes. In addition, spraying also results in a reduction in safety, for example slippery floors in the immediate vicinity of the machines and also breathing difficulties and skin irritation produced by sprayed droplets which are dispersed in the form of fine mists. To reduce the spraying of textile lubricants during the production and further processing of fibers, it has already been repeatedly proposed to add polymer compounds to the textile lubricants. For example, it is known from U.S. Pat. No. 4,400,281 that textile lubricants based on hydrocarbons, such as mineral oils, and/or fatty acid esters and/or fats and/or oils containing high molecular weight polymers of $C_{4-20}$ $\alpha$-monoolefins show improved adhesion to the fiber surface. In addition, it is known from European patents EP 261 415 and EP 127 293 that the use of high molecular weight polyisobutenes and the use of copolymers containing butenes in combination with $C_{5-20}$ $\alpha$-olefins as monomer constituents reduce the spray of winding oils during the processing of yarns. The winding oils described in U.S. Pat. No. 4,098,702 contain polymers to improve the viscosity index, for example polyisobutenes having molecular weights in the range from 20,000 to 2,000,000, polyalkyl styrenes having molecular weights in the range from 20,000 to 2,000,000 or polymethacrylates having molecular weights in the range from 300,000 to 800,000, and hence to improve the adhesion of the winding oils to the fiber surface.

DESCRIPTION OF THE INVENTION

Object of the Invention

In many cases, however, the reduction in the spraying of textile lubricants, particularly spinning finishes, from fiber surfaces achieved with known polymer compounds is still unsatisfactory. Accordingly, the problem addressed by the present invention was to develop spinning finishes which, compared with known spinning finishes, would show distinctly improved adhesion to the fiber surfaces and which would only be sprayed off in very small quantities, if at all, at the high filament speeds typically applied today.

SUMMARY OF THE INVENTION

It has now been found that the stringent demands imposed on the spinning finishes to be developed are satisfied if spinning finishes in the form of aqueous emulsions or aqueous solutions contain water-soluble polymer compounds having weight average molecular weights of more than $10^6$.

Accordingly, the present invention relates to spinning finishes based on smoothing agents, emulsifiers, antistatic agents and/or wetting agents containing polymer compounds in the form of aqueous emulsions or aqueous solutions, characterized in that they contain one or more of the following water-soluble polymer compounds having weight average molecular weights of more than $10^6$: polyalkylene oxides and/or polyacrylamides and/or polymethacrylamides and/or copolymers of acrylamide and/or methacrylamide and unsaturated carboxylic acids containing 3 to 5 carbon atoms.

The present invention also relates to a process for reducing the spraying of spinning finishes from fiber surfaces, characterized in that, immediately after the capillaries emerge from the spinning jet, spinning finishes containing one or more of the following water-soluble polymer compounds having weight average molecular weights of more than $10^6$: polyalkylene oxides and/or polyacrylamides and/or polymethacrylamides and/or copolymers of acrylamide and/or methacrylamide and unsaturated carboxylic acids containing 3 to 5 carbon atoms, in the form of aqueous emulsions or aqueous solutions are applied to the filament bundles.

The present invention also relates to the use of water-soluble polyalkylene oxides having weight average molecular weights of more than $10^6$, water-soluble polyacrylamides and/or polymethacrylamides having weight average molecular weights of more than $10^6$ and/or water-soluble copolymers of acrylamide and/or methacrylamide and unsaturated carboxylic acids containing 3 to 5 carbon atoms having weight average molecular weights of more than $10^6$ in aqueous emulsions or aqueous solutions of spinning finishes to reduce the spraying of the spinning finishes from fiber surfaces.

DESCRIPTION OF THE PREFERRED EMBODIMENTS

The content of water-soluble polymer compounds having weight average molecular weights of more than $10^6$ in the aqueous emulsions or in the aqueous solutions of the spinning finishes according to the invention is preferably between 0.0001 and 0.3% by weight and more preferably between 0.005 and 0.05% by weight. Polyethylene oxides, polyacrylamides and/or copolymers of acrylamide carboxylic acids containing 3 to 5 carbon atoms are preferably used as the water-soluble polymer compounds having weight average molecular weights of more than $10^6$. Polyethylene oxides having weight average molecular weights of more than $10^6$ are marketed, for example, by Union Carbide as powders under the names of Polyox® WSR301 and Polyox® WSR Coagulant while polyacrylamides having weight average molecular weights of more than $10^6$ are marketed, for example, by Henkel KGaA under the name of Ferrocryl® or by Stockhausen under the name of Praestol®. Copolymers of acrylamide and unsaturated carboxylic acids containing 3 to 5 carbon atoms, for example copolymers of acrylamide and acrylic acid, having weight average molecular weights of more than $10^6$ are obtainable, for example, under the name of Superfloc® (manufacturer: Cyanamid).

In a particularly preferred embodiment, polyethylene oxides are used in spinning finishes as the water soluble polymer compounds having weight average molecular weights of more than $10^6$.

Either water-soluble polymer compounds having weight average molecular weights of more than $10^6$ are added to aqueous emulsions or aqueous solutions of spinning finishes containing smoothing agents, emulsifiers, antistatic agents and/or wetting agents and, optionally, other additives or corresponding aqueous emulsions or aqueous solutions of spinning preparations are added to water-soluble polymer compounds having weight average molecular weights of more than $10^6$. In the production of the spinning finishes according to the invention, the water-soluble polymer compounds are preferably used in the form of aqueous solutions. The aqueous polymer-containing spinning finish emulsions or solutions obtained preferably contain 0.0001 to 0.3% by weight and, more preferably, 0.005 to 0.05% by weight of water-soluble polymers having weight average molecular weights of more than $10^6$ and have a total active substance content of 3 to 40% by weight. Based on the total active substance content, polymer-free aqueous emulsions or solutions of spinning finishes preferably contain 35 to 95% by weight of smoothing agents, 0 to 55% by weight of emulsifiers, antistatic agents and/or wetting agents, 0 to 10% by weight of additives, for example pH regulators, filament compacting agents, bactericides and/or corrosion inhibitors.

Suitable smoothing agents in spinning finishes according to the invention are, for example, mineral oils, carboxylic acid esters prepared from aliphatic $C_{8-22}$ carboxylic acids and linear and/or branched, optionally alkoxylated $C_{1-22}$ alkyl alcohols, for example isobutyl stearate, n-hexyl laurate, tallow fatty acid 2-ethylhexyl ester, coconut oil fatty acid triglycerides and/or trimethylol propane tripelargonate; silicones, for example dimethyl polysiloxane; and/or polyalkylene glycols, for example ethylene oxide/propylene oxide copolymers having average molecular weights of 600 to 6,000. Suitable emulsifiers, wetting agents and/or antistatic agents are anionic, cationic and/or nonionic surfactants, such as mono- and/or diglycerides, for example glycerol monooleate and/or glycerol dioleate; alkoxylated, preferably ethoxylated and/or propoxylated, fats, oils, $C_{8-22}$ fatty alcohols and/or $C_{8-18}$ alkylphenols, for example castor oil, ethoxylated with 10 to 40 moles ethylene oxide (EO), and/or $C_{16-18}$ fatty alcohols alkoxylated with ethylene oxide and/or propylene oxide; optionally alkoxylated $C_{8-22}$ fatty acid mono- and/or di-ethanolamides, for example optionally ethoxylated oleic acid mono- and/or diethanolamide, tallow fatty acid mono- and/or diethanolamide and/or coconut oil fatty acid mono-and/or diethanolamide; alkali metal and/or ammonium sulfonates of optionally alkoxylated $C_{8-22}$ alkyl alcohols, $C_{8-22}$ alkenyl alcohols and/or aromatic alcohols; reaction products of optionally alkoxylated $C_{4-22}$ alkyl alcohols with phosphorus pentoxide or phosphorus oxychloride in the form of their alkali metal, ammonium and/or amine salts, for example phosphoric acid esters of optionally ethoxylated $C_{12/14}$ fatty alcohols; alkali metal and/or ammonium salts of $C_{8-22}$ alkyl sulfosuccinates, for example sodium dioctyl sulfosuccinate; and/or amine oxides, for example dimethyl dodecylamine oxide. It is important to bear in mind in connection with this exemplary list of smoothing agents, emulsifiers, antistatic agents and/or wetting agents that many of the substances mentioned perform not just one function, but several functions in spinning finishes. For example, a smoothing agent may also act simultaneously as an antistatic agent and/or as an emulsifier.

Emulsifiers, antistatic agents and/or wetting agents may be mixed in any ratio with one another for use in the spinning finishes according to the invention.

The spinning finishes according to the invention may contain as additives pH regulators, for example aliphatic $C_{1-22}$ carboxylic acids and/or $C_{1-4}$ hydroxycarboxylic acids, such as acetic acid, glycolic acid and/or oleic acid, alkali metal hydroxides, such as potassium hydroxide, and/or amines, such as triethanolamine; filament compacting agents, for example fatty acid sarcosides and/or copolymers with maleic anhydride and/or polyurethanes according to DE 38 30 468; bactericides and/or corrosion inhibitors.

Polymer-containing spinning finishes in the form of aqueous emulsions or solutions are applied in known manner immediately after the capillaries leave the spinning jet. The finishes, which have a temperature of 18° to 30° C., are applied by applicator rollers or by metering pumps via suitable applicators. The quantity of active substance (oil) applied with the spinning finish emulsions or solutions according to the invention is between 0.3 and 2.0% by weight, based on the weight of the filament bundles. After the treatment with the finishes, the filament bundles are wound onto spools. The filament bundles may consist, for example, of polyesters, polyamides, polyolefins, and/or polyacrylics.

The spinning finishes according to the invention adhere very firmly to fiber surfaces and are sprayed off in only very small quantities at the high filament speeds typically applied today.

EXAMPLES

Percentages are by weight.

Composition of the spinning finish 78.5% isobutyl stearate

5% oleyl/cetyl alcohol ×5 moles EO 2.2% coconut oil fatty acid monoethanolamide ×4 moles EO 0.8% oleic acid 6% Tergitol® 15S3 (secondary fatty alcohol×3 moles EO, a product of Union Carbide)

6% Tergitol® 15S7 (secondary fatty alcohol×7 moles EO, a product of Union Carbide)

1.5% water

An aqueous emulsion was prepared from 150 g of the above-mentioned spinning finish and 840 g water and 10 g of an aqueous 1% by weight Polyox® WSR301 solution were stirred into the emulsion thus prepared at 20° C. Polyester (167 dtex/34 filaments) was spun at a speed of 3,200 meters per minute. The polymer-containing spinning finish emulsion which had a temperature of 20° C. was applied via a metering pump (amount of oil applied: 1.5%) immediately after the capillaries had left the spinning jet. At the first place after application of the spinning preparation at which the fiber bundle changed its direction of travel, the quantity sprayed off was collected and weighed. By comparison with the spinning finish with no added polymer, a reduction in the quantity sprayed off of 82% was achieved with the polymer-containing spinning finish.

The invention claimed is:

1. A process for reducing the spraying of spinning finishes from fiber surfaces, wherein, immediately after the fiber capillaries emerge from the spinning jet, spinning finishes in the form of aqueous emulsions or aqueous solutions are applied to the fiber surfaces, said spinning finishes containing an effective amount of one or more water-soluble polymer compounds having weight average molecular weights of more than $10^6$ and selected from the group consisting polyalkylene oxides, polyacrylamides, polymethacrylamides, and copolymers of acrylamide and methacrylamide with unsaturated carboxylic acids containing 3 to 5 carbon atoms.

2. A process as claimed in claim 1, wherein the aqueous spinning finish emulsions or solutions contain 0.005 to 0.05% by weight of said water-soluble polymer compounds.

3. A process as claimed in claim 2, wherein said water-soluble polymer compounds are selected from the group consisting of polyethylene oxides, water-soluble polyacrylamides, and water-soluble copolymers of acrylamide and unsaturated $C_{3-5}$ carboxylic acids.

4. A process as claimed in claim 3, wherein the water-soluble polymer compounds are polyethylene oxides.

5. A process as claimed in claim 1, wherein the aqueous spinning finish emulsions or solutions contain 0.0001 to 0.3% by weight of said water-soluble polymer compounds.

6. A process as claimed in claim 5, wherein said water-soluble polymer compounds are selected from the group consisting of polyethylene oxides, water-soluble polyacrylamides, and water-soluble copolymers of acrylamide and unsaturated $C_{3-5}$ carboxylic acids.

7. A process as claimed in claim 6, wherein the water-soluble polymer compounds are polyethylene oxides.

8. A process as claimed in claim 1, wherein said water-soluble polymer compounds are selected from the group consisting of polyethylene oxides, water-soluble polyacrylamides, and water-soluble copolymers of acrylamide and unsaturated $C_{3-5}$ carboxylic acids.

9. A process as claimed in claim 8, wherein the water-soluble polymer compounds are polyethylene oxides.

* * * * *